US005096076A

United States Patent [19]

Elliott et al.

[11] Patent Number: 5,096,076

[45] Date of Patent: Mar. 17, 1992

[54] TYPE E COUPLER YOKE

[75] Inventors: William O. Elliott, Pittsburgh; Beatrice Schulte, Middland, both of Pa.

[73] Assignee: McConway & Torley Corporation, Pittsburgh, Pa.

[21] Appl. No.: 682,885

[22] Filed: Apr. 8, 1991

Related U.S. Application Data

[63] Continuation of Ser. No. 453,362, Dec. 18, 1989, abandoned, which is a continuation of Ser. No. 745,685, Jun. 17, 1985, abandoned.

[51] Int. Cl.[5] ..... B61G 9/00

[52] U.S. Cl. ..... 213/67 A

[58] Field of Search ..... 213/67 A, 67 R, 69, 213/50, 61, 51, 62 R, 63, 64, 70

[56] References Cited

U.S. PATENT DOCUMENTS

| | | | |
|---|---|---|---|
| 1,128,356 | 2/1915 | O'Conner | 213/67 A |
| 1,633,670 | 6/1927 | Kodel | 213/67 A |
| 1,921,011 | 8/1933 | Spence | 213/67 A |
| 1,951,318 | 3/1934 | Barrows | 213/67 A |

*Primary Examiner*—Robert J. Oberleitner
*Assistant Examiner*—Mark T. Le
*Attorney, Agent, or Firm*—Armstrong, Nikaido, Marmelstein, Kubovcik & Murray

[57] ABSTRACT

A coupler yoke for an E-Type coupler is constructed with a blunt nose by foreshortening the length of the nose. The nose length is 3 inches as measured from a point at the forward most part of a semicircular end of the keyslot to the forward most end of the nose portion. The walls of the nose portion are solid with a trapezoidal cross-sectional shape. The nose wall extend rearwardly where they merge with keyslot ribs at each side of the keyslot in the head portion of the yoke.

16 Claims, 2 Drawing Sheets

TYPE E COUPLER YOKE

This application is a continuation of application Ser. No. 07/453,362 filed Dec. 18, 1989, now abandoned, which is a continuation of copending application Ser. No. 06/745,685 filed on June 17, 1985, now abandoned.

BACKGROUND OF THE INVENTION

This invention relates to a yoke for an E-type coupler for a railway vehicle and, more particularly, to such a yoke having a blunt nose portion by a foreshortened length of less than 3 ½-inches to facilitate removal of the yoke together with the draft gear from a railway vehicle as well as if desired forming the nose portion of the yoke with uniformly thick walls having smooth convex outer surfaces to strengthen and improve the service life of the yoke by avoiding deformations at the keyslot areas immediately adjacent the nose portion of the yoke.

Couplers used to connect together two railway vehicles are joined to the vehicles by way of coupler yokes. A draft gear pocket is formed in a coupler yoke to receive a draft gear assembly for dampening the pull and buff forces which must be transferred between the coupler head and the railway vehicle. A standard AAR E-Type coupler yoke is a unitary casting with a symmetrical configuration about longitudinal center planes. The yoke casting includes top and bottom straps extending between a rear end portion forming a rear draft seat and a yoke head where walls form the front of the draft gear pocket facing toward the rear draft gear seat. The area surrounded by the front draft gear wall draft gear seat and the top and bottom straps form a draft gear pocket in which a draft gear can operate to cushion the buff and pull forces occurring in train service. The keyslot walls in the yoke head diverge outwardly at each of opposite sides of the yoke. Each keyslot wall is provided with key slots extending generally parallel with the straps. Semicircular ends of the keyslots avoid a localization of forces on the casting by a horizontally arranged key used to interconnect the yoke with the shank portion of a railway coupler. Forwardly of the keyslot walls there is a nose portion which projects into a central cavity of a striker casting above a striker carrier which is an integral part of the striker casting and used to engage and support the shank of the coupler. The striker casting is secured to a center sill of the railway vehicle. Front draft lugs on the rear portion of the striker casting engage a front follower, which is a rectangular block of metal, interposed between the draft gear and the front draft lugs of the striker for transferring forces from the draft gear.

The Y40 and Y41 standard yokes for type E couplers can offer significant improvements to their operation in a railway vehicle through an improved construction of the nose portion of the yokes to overcome two problems which have been found to exist. Firstly, it is frequently a difficult and tremendous task to remove a yoke with draft gear of E-Type coupler as a unit from a railway vehicle because yoke resides at a position that is too far forwardly of the vehicle whereby the nose portion and the coupler carrier of the striker interfere during the removal process even though such interference should not occur by reason of the design of the standard parts. Secondly, deformations of the yoke casting at the yoke keyslot area are caused by loading on the keyslot peripheral rib by the key. Sometimes cracks occur in the yoke casting at the forward end of the keyslot.

It is necessary from time to time to remove the draft gear from a railway vehicle for servicing and/or replacement. It is necessary to remove the yoke with the draft gear and follower block located within the draft gear pocket thereof from the vehicle after which the draft gear can be removed from the yoke at a site remote to the railway vehicle. As is well known in the art, tremendous loads are encountered by draft gear when transmitting pull and buff forces in train service. These loads are so great that dimensional clearances established by the design not withstanding manufacturing tolerances actually change because the yoke casting stretches to such an extent that intended clearances necessary to the removal of the yoke with the draft gear in tact are reduced to a point where yoke removal is impossible.

In order to remove the yoke and draft gear from the railway vehicle, it is always necessary to compress the draft gear in the draft gear pocket approximately ⅛-inch or greater in order to provide a clearance at the front and rear draft lugs so that the draft gear and yoke assembly is free to slip out of the pocket formed in the center sill. The draft gear is usually compressed by placing a compression jack in the opening between the keyslot walls such that one part of the compression jack can push against the front follower block and thereby also an extendable member of the draft gear. The compression jack is supported by the yoke through the use of a cross member that extends through the keyslot openings in the keyslot walls. The yoke must be shifted rearwardly of the railway vehicle when an interference occurs between the nose of the yoke and the coupler carrier which prevents the lowering of the draft gear and yoke assembly passed the coupler carrier. Attempts in the past to alleviate the interference problem required the placement of a shim having a suitable thickness usually ⅜-inch or greater between the rear of the draft gear and the rear draft gear seat. This gap must be created by forcing the yoke rearwardly in a manner simulating a buff condition. The precompression force of the draft gear is resisted by rear lugs on the center sill and front draft lugs on the striker that are in a forced transmitting relation with the draft gear via the draft gear follower. The purpose of the spacer between the rear of the yoke and the draft gear is to limit forward movement of the yoke when the compression jack is operated to compress the draft gear. The draft gear is then compressed through the use of the compression jack while the spacer holds the yoke at a rearward position to relieve the front and rear draft lugs of the precompression forces developed by the draft gear. However, this procedure may not be successful because there may still be insufficient clearance between the nose portion of the yoke and the striker carrier due to, for example, stretching of the yoke during use. In order to move the yoke still further rearwardly to gain adequate clearance between the nose portion of the yoke and the striker carrier, the draft gear must be first compressed to an extent sufficient to place spacers between the front stops and the front follower. The compression jack must then be released locking the draft gear between rear stops and the front spacers and thereby slide the yoke rearwardly with respect to the striker casting. A spacer must then be placed between the rear of the draft gear and yoke rear draft gear seat which has a thickness sufficiently great to provide the necessary clearance between the nose portion of the yoke and the striker carrier. Thereafter the draft gear is then compressed so that the draft gear is out of compressive engagement between the front and rear draft lugs and the shims can be removed. This procedure is costly, time consuming and must be carried out under difficult working conditions since the yoke must be retained in the downwardly facing pocket of the center sill while ensuring access to various sites for the placement and removal of spacers and shims.

The present invention provides an improved construction for the nose portion of a yoke to alleviate the problem encountered incident to the removal thereof from a railway vehicle and, at the same time, the present invention prevents deformations in the yoke keyslot area particularly at the nose portion of a yoke which distorts and even fracture sometimes after a relatively short period of time. The service life of a yoke can be very limited particularly where a yoke is provided in a unit train coal car. The deformation to the keyslot at the nose portion can be so severe that the yoke must be replaced. The type of deformation which has been found to occur is, it is believed, only caused by loading of the keyslot peripheral rib located in the keyslot walls and used to form a connection with the horizontal key with the shank portion of the coupler. As a railway car is subject to varying track conditions, factors such as rocking and super elevations cause the mating couplers to angle with respect to the car applying a torsional force to the coupler draft assembly as well as buff or draft forces. The torsional force produces a certain magnitude of a twisting angle between the interconnected components. The components will angle freely until clearances prohibit further twisting.

A coupler can imposing a turning movement on the key while restrained in the yoke keyslot. The coupler upon continued turning movement after metal to metal contact between the key and walls of the keyslot in the yoke, will turn the yoke until interference exists between the follower block and the yoke straps. With data giving steady state train action loads normally of 200,000 pounds, restraints on further yoke twisting show, with a coefficient of friction equal to 0.2, a 40,000 pound frictional force. This force is distributed over the follower-striker lug contact which prevents the follower from twisting. In an AAR E-Type coupler shank and yoke arrangement, the maximum angle which the key can attain under these conditions is about 5.25 degrees maximum, and a minimum of about 0.75 degrees. When the maximum and minimum angling of the key is compared with possible angling of the bolster and side frames on uneven or poor quality track, it is found that the maximum bolster rock relative to the track is 7.393 degrees peak-to-peak. Side frame rock relative to bearing adapters is 15 degrees peak-to-peak when two adjacent cars rock in opposite directions. This gives rise to a possible 22.39 degree angling between coupled cars. Since the torsional angling of couplers is limited relative to each other, then the remaining torsional displacement of 22.39 degrees must be absorbed by the system. When the torsional angling is compounded with the vertical angling the draft key binds on the key-slot rib creating a point load on the rib periphery.

SUMMARY OF THE INVENTION

It is an object of the present invention to provide an improved construction for the nose portion of a standard AAR type E coupler yoke which will avoid the problems and shortcomings innumerated hereinbefore.

It is a further object of the present invention to provide an improved construction for an AAR type yoke for an E-Type coupler shank in which the nose portion is foreshortened and embodies a blunted and robust configuration to prevent deformation of a forward portion of a keyslot at the nose portion of the yoke which heretofore brought about failure and a need to replace the entire yoke in a railway vehicle.

More particularly, according to the present invention, there is provided a coupler yoke including a butt end portion having a rear draft gear seat at a generally right angle relation with each of top and bottom straps extending in a generally parallel and spaced apart relation to a yoke head portion having outwardly diverging keyslot walls extending from front draft gear pocket walls which face toward the rear draft seat, a draft gear pocket being defined within the area surrounded by the rear draft gear seat, the front draft gear pocket walls and the top and bottom straps, the keyslot walls having elongated keyslot openings each with a semicircular front end from which a nose portion extends forwardly therefrom, the nose portion having a blunted contour to the contour of a standard yoke by a foreshortened length of less than 3 ½-inches from a point at the forward most surface of the semicircular front end inside the keyslot to a forward most end of the nose portion.

The present invention also preferably provides that the nose portions of the coupler yoke which extends beyond the keyslot openings are defined by solid substantially trapezoidal walls with smooth convex outer front nose surface and smooth inner surfaces. The outer convex surface of each nose portion extends rearwardly preferably beyond the semicircular front end of the keyslot openings through a short distance which is sufficient to withstand opposed torsional forces by a key on the forward end of the keyslot opening. The convex outer surface of each nose portion merges with ribs that extend rearwardly along the keyslot opening in keyslot walls and form a step like depression at opposite sides of the keyslot opening for merging with conventional keyslot walls.

The foreshortened configuration of the nose portion produces a blunted contour of the nose portion of the yoke to facilitate removal from a center sill of a railway vehicle without the need for longitudinally shifting the yoke in the center sill rearwardly away from the striker to avoid interference between the striker carrier and the nose portion of the yoke.

These features and advantages of the present invention as well as others will be more fully understood when the following description is read in light of the accompanying drawings in which.

Figure 1:
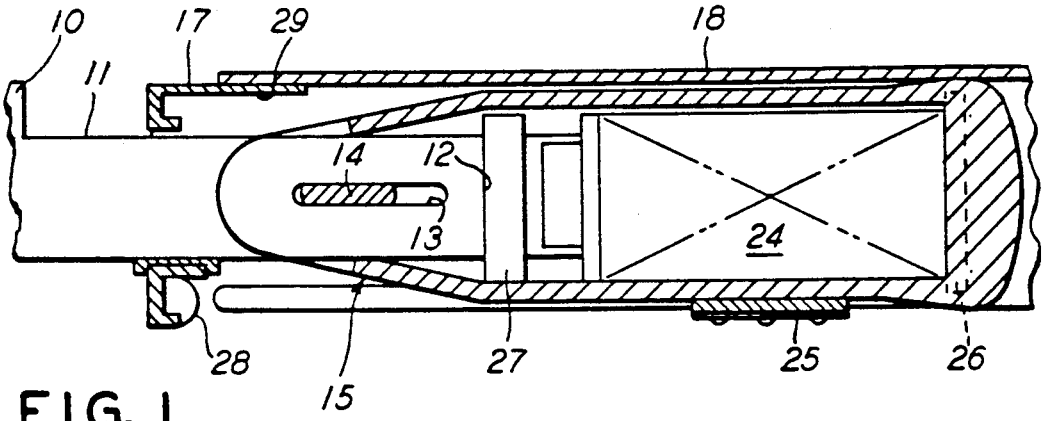
FIG. 1 is an elevational view, partly in section, of an E-Type coupler assembly which includes a coupler yoke embodying the features of the present invention.
Figure 2:
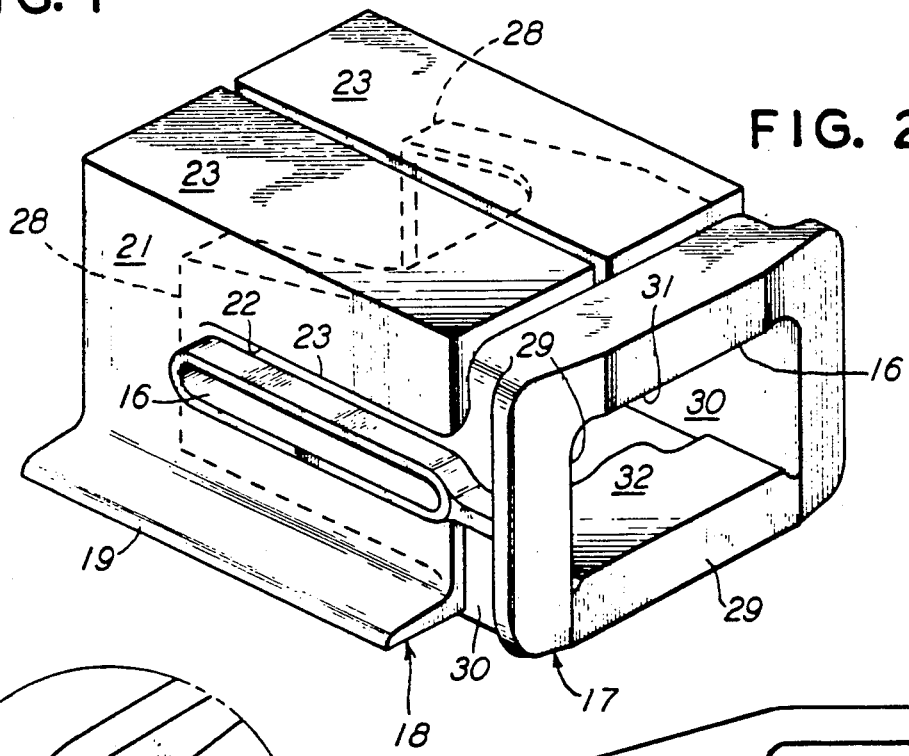
FIG. 2 is an isometric view of a Z-sill for a railway vehicle together with a striker which form part of the coupler assembly shown in FIG. 1.

In FIG. 1 of the drawings, the E-Type railway coupler assembly includes a coupler head 10 constructed in a manner, per se, well known in the art. Extending rearwardly of the coupler head is a coupler shank 11 which conforms to AAR standards for an E-Type coupler shank and is characterized by a butt end 12 forwardly of which there is a horizontal keyslot 13 in the coupler shank. A draft key 14 extends through the keyslot and projects from opposite sides of the coupler shank outwardly through keyslot openings, as will be described in greater detail hereinafter, in the nose portion of a yoke 15. Opposite ends of the draft key also extend through keyslot openings 16 in a striker casting 17. The striker casting, as best shown in FIG. 2, is secured by welded metal, preferably in the manner described in U.S. Pat. No. 4,445,617 to a center sill 18. The sill shown in FIG. 2 of the drawings is a Z-sill made up of two Z-shaped sections having flange portions 19, upstanding side sill walls 21 in which horizontal slots 22 are formed to receive horizontal ribs of the striker casting. The striker casting is welded to the sill about the periphery of the ribs which are provided on opposite sides of the striker casting. The side walls 21 of the sill extend to top walls 23 which are welded together along their longitudinal edges so that a pocket is formed for receiving the striker casting and, rearwardly of the striker casting, the yoke and draft gear are located in the pocket of the Z-sill.

A yoke strap carrier 25 maintains the yoke in the pocket of the Z-sill. The rearward most end of the draft gear engages rear draft lugs 26 that extend from the inside face surfaces of walls 21. The forward end of the draft gear presses against a follower 27 which is in turn supported by front draft lugs 28 formed on the rear portion of the striker casting. A generally rectangular, continuous striker face 29 protrudes from the forward end of the Z-sill. The striker face is part of spaced apart side walls 30 which are joined together along their top edge portion by a top wall 31 and a bottom wall 32, which is commonly referred to in the art as a striker carrier. As shown in FIG. 1, the striker carrier engages the bottom surface of the coupler shank to support the coupler during lateral, side-to-side movement as well as longitudinal movement of the coupler shank in buff and pull conditions.

Figure 3:
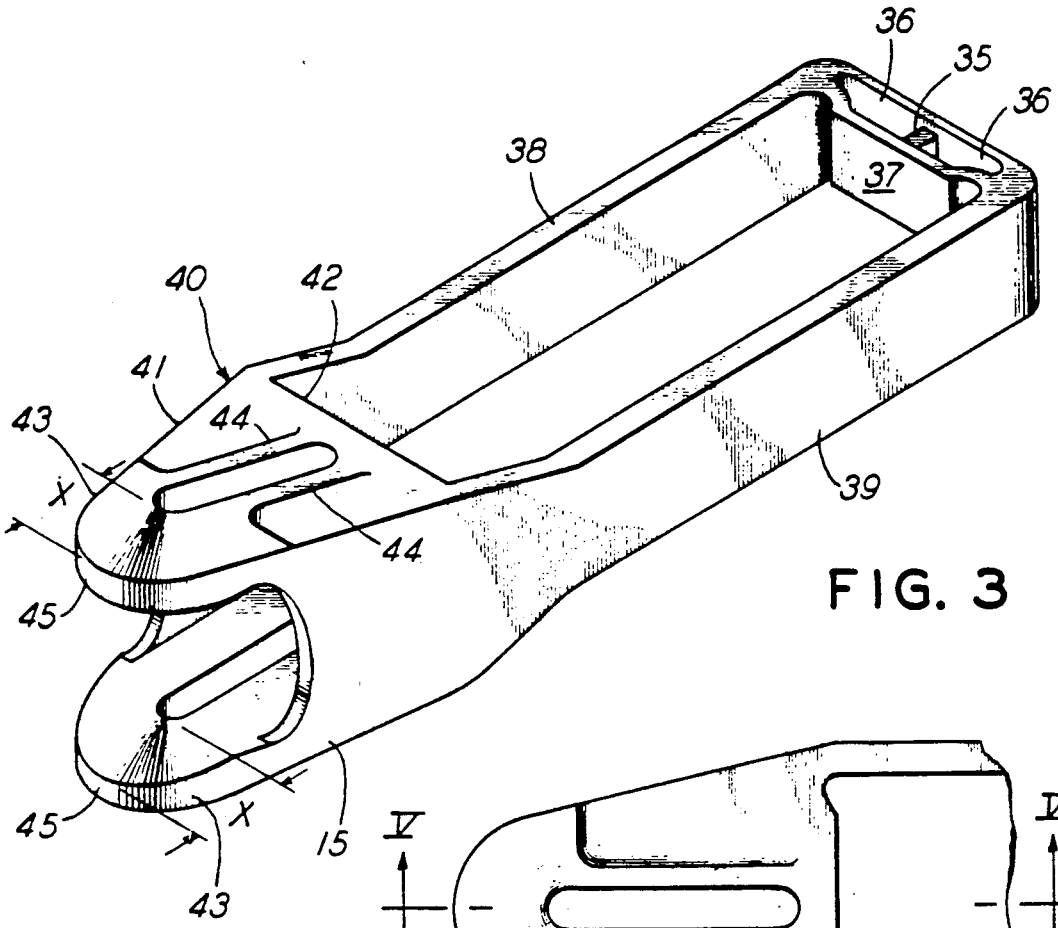
FIG. 3 is a view in perspective of an E-Type coupler yoke embodying the features of the present invention.
Figure 4:
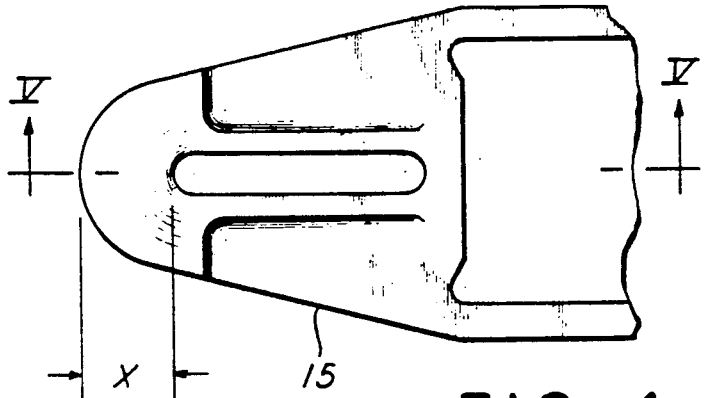
FIG. 4 is a view illustrating the keyslot which is provided in the head portion of the yoke shown in FIG. 3 and embodying the features of the present invention.
Figure 5:
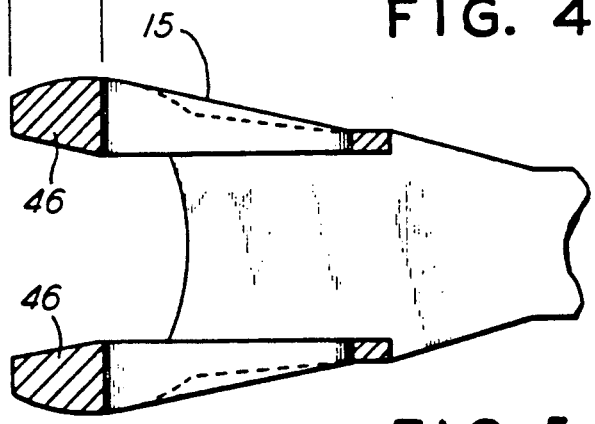
FIG. 5 is a view taken along lines V—V of FIG. 4.

In FIGS. 3–5, there is illustrated the details of the construction of a coupler yoke according to the present invention. The coupler yoke includes a butt end portion 35 having lightener pockets 36 at opposite sides of a rear draft gear seat 37 comprised of a generally planar face surface. Extending forwardly from the butt end portion are top and bottom straps 38 and 39 which extend to a yoke head 40. It will be understood by those skilled in the art that the yoke in the illustration of FIG. 3 is shown in a position which is rotated 90 degrees from the position of the yoke when operatively arranged in the center sill of a railway vehicle as shown in FIG. 1. Returning to the illustration of FIG. 3, the yoke head portion includes outwardly diverging keyslot walls 41 which commence at front draft gear walls 42 and extend forwardly to a nose portion 43. A draft gear pocket is defined in the yoke by the area surrounded by the rear draft gear seat 37, the front draft gear walls 42 and the top and bottom straps 38 and 39. The keyslot walls 41 are each provided with keyslot openings that extend lengthwise of the yoke, i.e., generally parallel with the top and bottom straps 38 and 39. The keyslot walls are provided with upstanding ribs 44. The end of each keyslot which is closely spaced from the front draft gear walls 42 has a semicircular rear portion and the end of the keyslot which is at the front nose portion 43 has a semicircular front end. The length of the nose portion 43 which is defined in FIGS. 3–5 as distance X is foreshortened to a length less than 3 ½-inches from a point at the forward most surface of the semicircular front end inside the keyslot to the forward most end of the nose portion. Preferably, the distance X is about 3 inches. The foreshortened length of the nose portion produces a blunted contour defined by edge surface 45. These edge surfaces are preferably defined by a radius struck from a point about ¼-inch rearwardly from the forward most surface of the semicircular front end of the keyslot and can be joined with a standard yoke contour for E-Type couplers identified as Y40 and Y41. A Y40 yoke has a 25 ⅝-inch long draft gear pocket whereas a Y41 yoke has a 36 ⅝-inch long draft gear pocket. The foreshortened length of the yoke nose portion alleviates the problems innumerated hereinbefore as well as a practice of removing, as by use of a cutting torch, a part of the rear portion of the striker carrier 32 (FIGS. 1 and 2) which was sometimes necessary to permit removal of the coupler yoke from the center sill. The degregation to the striker carrier could be overlooked in the replacement process for the yoke whereby inadequate support for the coupler might result due to weakening of the coupler carrier.

As can also be seen from FIGS. 3–5, the nose portion of the coupler yoke 15 which extends beyond the keyslot openings in the keyslot walls is defined by trapezoidally shaped, in cross section, (FIG. 5) walls 46 each with a smooth convex outer front nose surface and a smooth inner surface. The trapezoidal cross sectional shape of each wall 46 extends rearwardly, preferably beyond the semicircular front end of the keyslot opening through a short distance along the keyslot to a point where the wall thickness can smoothly merge with the ribs 44. The point of merger is sufficiently rearward to increase the strength of the forward portion of the keyslot wall against deformations of the type shown in FIGS. 6 and 7. It will be observed that the extension of the uniformly thick wall at each nose portion of the yoke terminates at generally the formation of walls sections 46 which extend transversely to the length of the keyslot.

Figure 7:
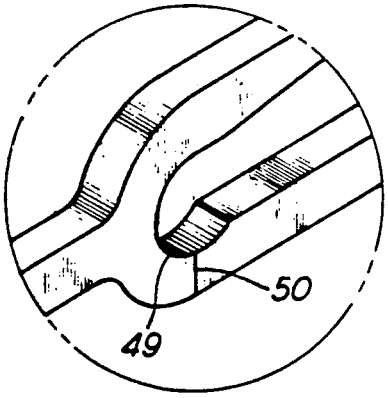
FIG. 7 PRIOR ART
FIG. 7 is an enlarged fragmentary view of the keyslot opening in the keyslot walls shown in FIG. 6 and illustrating, in an exaggerated manner, distortion of the wall of the keyslot opening.
Figure 6:
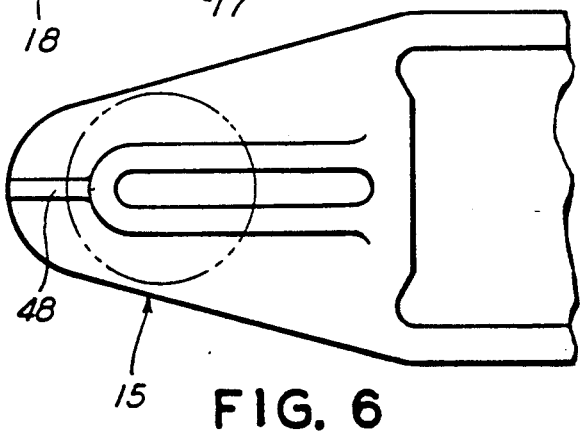
FIG. 6 PRIOR ART
FIG. 6 is a view similar to FIG. 4 but illustrating the head portion of a standard AAR E-Type coupler yoke.

By way of contrast to the yoke of the present invention, in FIG. 6, a standard Y40 AAR E-Type coupler yoke is shown in which the nose portion is provided with a single upstanding rib 48 extending from the semicircular rib portion at the forward end of the keyslot to the end of the yoke. The wall thickness of the yoke nose end portion at the top and bottom sides of the ribs 48 are of inadequate strength to prevent severe distortion to the forward portion of the keyslot opening which is illustrated by FIG. 7. In FIG. 7, the keyslot at its forward lower surface can be deformed, as shown to an exaggerated extent, by torsional angling combined with vertical angling of the coupler which causes the draft key to bind in the keyslot rib creating a point loading condition at point 49 in the periphery of the rib. This condition is exaggerated in FIG. 7 but nevertheless have been found to result in a failure in the yoke casting because of a crack which is typically illustrated and identified by reference numeral 50.

We claim as our invention:

1. An elongated railway coupler yoke of enhanced service life and removably mountable within a hollow center sill of a railway car body with a front end of said yoke disposed adjacent a slotted hollow striker member mounted on and having a portion thereof extending into such hollow center sill in a position about and forwardly of a front end of such yoke, when such yoke is disposed in such hollow center sill, and adapted to engage an end of a coupler shank, said yoke comprising:

(A) a rear yoke portion including a rear draft gear seat extending transversely of a yoke length;

(B) a pair of elongated, substantially parallel spaced-apart top and bottom strap members each having an inner surface, an outer surface, a front end and a rear end, said rear end of each strap member being joined to said rear draft gear seat; and (C) a hollow hear portion adapted for removable reception of such coupler shank within said hollow head portion, said hollow hear portion including:

(a) a pair of opposed head portion top and bottom wall members having rear ends thereof respectively joined to said front ends of said top and bottom strap members and having substantially flat inner and outer surfaces merging with corresponding surfaces of said top and bottom strap members, said head portion top and bottom wall members converging inwardly and forwardly from respective lines of joinder with said top and bottom strap members toward a longitudinal centerline of said yoke, and having rearwardly concave front ends spaced apart a sufficient distance to accommodate insertion of such coupler shank therebetween, and (b) a pair of opposed head portion side wall members including:

(i) rear portions thereof having a front draft gear wall member in opposed and substantially parallel relationship to said rear draft gear seat and joined to said front ends of said top and bottom strap members and with said top and bottom strap members and said draft gear seat defining a draft gear pocket for removable reception therein of a draft gear which is removable, together with said yoke, from such hollow center sill;

(ii) front portions extending forwardly of said front draft gear wall member;

(iii) an elongated key slot extending through a front portion of each of said pair of opposed head portion side wall members from an inner surface to an outer surface thereof, said key slot in a first head portion side wall member being in registered relation to said key slot in a second opposed head portion side wall member, each key slot having side walls parallel to and equally spaced from a horizontal plane through said longitudinal centerline of said yoke and front and rear end walls of generally semicircular shape, the length of said key slot being greater than that of a draft key removably insertable therethrough and through slots in such striker member for connecting said yoke and such striker member to a corresponding slot in such coupler shank; and (iv) wherein said inner surfaces of said front portions lie in planes substantially parallel to and spaced from a vertical plane through said longitudinal centerline of said yoke and extending forwardly to a front end of said key slot substantially at which point said inner surfaces diverge outwardly of said vertical plane; and (v) wherein each head portion side wall member has a nose projecting forwardly of a rearmost point of concave front ends of said head portion top and bottom wall members, a peripheral edge of a forward end portion of each nose being in a form of a circular arc, said nose on a first head portion side wall member being spaced apart from said nose on a second head portion side wall member a sufficient distance to accommodate insertion of such coupler shank therebetween and in juxtaposable relation to such striker member when said yoke is mounted within such hollow center sill; and (vi) wherein each said key slot extends lengthwise from a location proximate to and spaced from said front draft gear wall member to a location less than 3½ inches rearwardly of a forwardmost end of a corresponding nose; and (vii) wherein, in cross sections of each said nose in a first, horizontal plane extending through a longitudinal centerline of a corresponding key slot and in a second plane normal to said first plane an inner surface of each said nose appears as a straight line and an outer surface of each said nose appears substantially as a convex line, and (viii) wherein a thickness dimension of each said nose increases in a rearwardly extending direction from a minimum thickness at a forwardmost end thereof to a maximum thickness around a corresponding semicircular front end key slot wall and rearwardly thereof along opposed front portions of corresponding key slot side walls; and (ix) wherein, terminal portions of a convexly-surfaced maximum thickness portion of each said nose adjacent respective key slot side walls merge smoothly into a pair of ribs of uniformly decreasing thickness in a direction extending rearwardly and substantially along remaining lengths of each of said respective key slot side walls, each of said ribs forming a portion of a corresponding key slot side wall adjacent the outer surface of the corresponding head portion side wall member and merging with said outer surface of said head portion side wall member at a position adjacent the corresponding rear slot end wall; and (x) wherein portions of the convexly-surfaced nose of each head portion side wall member, extending transversely thereof between corresponding ribs and top and bottom edges of each head portion side wall member, extend further rearwardly of a maximum thickness portion of each said nose along said ribs and decrease in thickness in a rearward direction and smoothly merge through a concave joinder with said outer surface of a corresponding head portion side wall member, thereby extending further along said key slot side wall a strengthening effect of the maximum thickness portion of each said nose and supplementing a strengthening effect of said ribs on said key slot side wall.

2. A coupler yoke, according to claim 1, having enhanced service life in use with an AAR E-type railway coupler, wherein an arcuate peripheral edge of a forward end portion of each said nose is defined by a radius of a circle lying in a vertical plane extending through a longitudinal centerline of a corresponding key slot with a center point of such circle spaced about ¼ inch rearwardly of a forwardmost point of a corresponding front key slot end wall.

3. A coupler yoke, according to claim 2, wherein each said key slot extends from a location proximate to and spaced from said front draft gear wall to a location about 3 inches rearwardly of a forwardmost end of each said nose.

4. A coupler yoke, according to claim 2, wherein the maximum thickness portion of each said nose merges with said ribs at points sufficiently rearwardly of a front portion of said key slot end wall to prevent deformation and cracking of a key slot area of said yoke under applied service stresses whereby service life of said yoke is effectively extended for a period up to a normal expected service life of a railway car.

5. An assembly mountable within an elongated hollow portion of a railway car center sill for accommodating buff and draft forces applied during service of a railway car in a direction of a longitudinal centerline of such center sill, such center sill having a first force-transmitting member within and adjacent a forward end of the center sill hollow portion and a second force-transmitting member within and adjacent a rearward end of the center sill hollow portion, such force-transmitting members being opposed to each other along such longitudinal centerline and adapted to transmit such forces to said assembly during service thereof in a railway car, said assembly comprising a coupler yoke according to claim 4 and a draft gear mounted in a draft gear pocket of said yoke wherein, after stretching of said yoke along its longitudinal centerline upon application thereto of such buff and draft forces during prolonged such service of said yoke and upon compression of said draft gear against such second force-transmitting member thereby forcing said yoke forwardly of the center sill along such longitudinal centerline, said nose of said yoke is free of interference with such first force-transmitting member and said assembly is non-destructively removable from said portion of said center sill.

6. In an AAR E-type railway coupler yoke having a yoke head provided with a pair of opposed elongated key slot members, each having an inner surface, an outer surface, a top edge and a bottom edge and a rounded forward extremity, an improved construction of said key slot members, wherein:

(A) said inner surface of each said key slot member includes a rearward portion lying in a plane substantially parallel to a vertical plane through a longitudinal centerline of said yoke head, and a forward portion of said inner surface lying in a plane inclined at an angle to said rearward portion of said inner surface in a direction of said outer surface of each said key slot member;

(B) a forward portion of each said key slot member includes a nose having a round-ended forward extremity; and (C) each said key slot member includes an elongated key slot with parallel side walls substantially equally spaced on opposite sides of a horizontal plane through said longitudinal centerline of said yoke, and semicircular front and rear end walls, said parallel side walls of each of said key slots extending through a corresponding key slot member from said inner surface to said outer surface thereof, each said key slot extending into a corresponding nose for reception in said key slot of a draft key of a width less than a length of said key slot so that such draft key can move within said key slot under influence of applied in-service stresses, which improvement comprises:

(a) said nose having an outer surface of convex shape in a width dimension from top to bottom of said key slot member and in a length dimension in a direction of a longitudinal centerline of a corresponding key slot;

(b) wherein a thickness dimension of said nose increases in a rearward direction from a forward extremity thereof to a maximum thickness extending to a position spaced rearwardly of a forwardmost point of front end walls of a corresponding key slot;

(c) wherein maximum thickness portions of a convexly-surfaced nose adjacent respective key slot side walls and extending transversely of said key slot wall member a distance less than a distance between said respective key slot side walls and a corresponding top edge and bottom edge of said key slot wall member merge smoothly with a pair of upstanding ribs constituting an outer portion of said respective key slot side walls, said ribs decreasing in thickness in a rearwardly direction and smoothly merging with said outer surface of said key slot member at positions adjacent a rear of said key slot end wall; and (d) wherein remaining portions of said convexly-surfaced nose extending transversely of said key slot member from a position adjacent front ends of corresponding ribs to said respective top and bottom edges of said key slot member, decrease in thickness in a rearward direction and smoothly merge through rearwardly terminal concave surface portions of said nose into said outer surface of said key slot member at positions intermediate front and rear extremities of said ribs.

7. An improved coupler yoke key slot member, according to claim 6, wherein said maximum thickness of said nose merges with said ribs at points sufficiently rearwardly of said front key slot end wall to prevent deformation and cracking of said key slot member under applied service stresses and effectively to extend said yoke service like up to a normal expected service life of a railway car.

8. An improved coupler yoke key slot member, according to claim 7, wherein said round-ended extremity of said nose has substantially a form of an arc described by a radius of a circle lying in a vertical plane extending through a longitudinal centerline of said key slot with a center point of such circle spaced about ¼ inch rearwardly of a forwardmost point of said front key slot end wall, and wherein said key slot extends into said nose to a point less than 3 ½ inches from a forwardmost point of said round-ended extremity of said nose.

9. An assembly mountable within an elongated hollow portion of a railway car center sill for accommodating buff and draft forces applied during service of a railway car in a direction of a longitudinal centerline of such center sill, such center sill having a first force-transmitting member within and adjacent a forward end of the center sill hollow portion and a second force-transmitting member within and adjacent a rearward end of the center sill hollow portion, such force-transmitting members being opposed to each other along such longitudinal centerline and adapted to transmit such forces to said assembly during service thereof in a railway car, said assembly comprising a coupler yoke having a yoke head provided with key slot members according to claim 8 and a draft gear mounted in a draft gear pocket of said yoke wherein, after stretching of said yoke along its longitudinal centerline upon prolonged application thereto of such buff and draft forces during such service of said yoke and upon compression of said draft gear against such second force-transmitting member thereby forcing said yoke forwardly of the center sill along such longitudinal centerline, said round-ended extremity of said nose of said yoke is free from interference with such first force-transmitting member and said assembly is non-destructively removable from said hollow portion of said center sill.

10. An assembly, according to claim 9, wherein said key slot extends into said nose to a point about 3 inches from a forwardmost point of said round-ended extremity of said nose.

11. Means for extending service life of an AAR E-type railway coupler yoke having a yoke head provided with a pair of opposed key slot members each having an inner surface, an outer surface, a top edge and a bottom edge, a forward portion of each of said key slot members including a nose having a rounded extremity, and an elongated key slot having parallel side walls and semicircular front and rear end walls extending through said key slot member from an inner surface to an outer surface thereof and forwardly thereof into said nose with a front end wall of said key slot spaced from said nose extremity, each of said key slots being adapted for removable insertion therein of a draft key of a width less than the length of said key slot so that such draft key can move within said key slot under influence of applied in-service stresses, said means serving to strengthen each of said key slot members and comprising:

(a) first key slot strengthening means including a nose having a convex outer surface in planes extending transversely and longitudinally of said key slot member, said nose increasing in thickness from a position adjacent said extremity to a maximum thickness portion surrounding said key slot front end wall and a forward portion of said key slot side walls;

(b) second key slot strengthening means including a pair of ribs each extending from a rearwardmost portion of said maximum thickness portion of said nose and rearwardly thereof in decreasing thickness along said key slot to a position adjacent said key slot rear end wall and there smoothly merging with said outer surface of said key slot member, one side of each rib forming a portion of a corresponding key slot side wall adjacent said outer surface of said key slot member and each rib having a width dimension extending transversely of said key slot member a distance less than that from said corresponding key slot side wall to a corresponding edge of said key slot member; and (c) a third key slot strengthening means including a continuation portion of said convexly-surfaced nose in a direction rearwardly and transversely of said key slot member and outwardly of said ribs to upper and lower edges of said key slot member, a thickness dimension of said continuation portion of said nose decreasing in a rearward direction and smoothly merging through a terminal concave surface with said outer surface of said key slot member at a position proximate to and rearwardly of forwardmost points of said ribs.

12. Means, according to claim 11, wherein said front end wall of said key slot is spaced from said nose extremity a distance less than 3 ½ inches.

13. Means, according to claim 11, wherein said front end wall of said key slot is spaced from said nose extremity a distance of about 3 inches.

14. A method of extending service life of an AAR Y40-type coupler yoke useful with AAR E-type railway couplers when mounted within a hollow portion of a railway car center sill having therein longitudinally opposed front and rear buff and draft force-transmitting members limiting forward and rearward movement of such yoke within such hollow portion of such center sill along a longitudinal center line thereof, such yoke being equipped with a pair of opposed key slot members having inner and outer surfaces and top and bottom edges, each key slot member having a forward portion thereof in a form of a rounded nose and an elongated key slot having parallel side walls and semicircular front and rear walls extending through each of said key slot members from the inner surface to the outer surface thereof and into each of the respective noses for reception in such key slots of a draft key of a width less than the lengths of said key slots so that such draft key can move within said key slots under influence of applied in-service stresses, which method comprises with respect to each such key slot member:

(1) forming a first portion of said nose with an outer convex shape in planes extending transversely and longitudinally of said key slot member and increasing in a thickness dimension of said first portion of said nose in a rearward direction from a forwardmost extremity of said nose to a maximum thickness at a forwardmost point of said front end wall of said key slot;

(2) forming a pair of continuations of said maximum thickness portion of said first portion of said nose rearwardly of said front end wall of said key slot side walls on both sides thereof and extending transversely of the key slot member from a key slot side wall for a distance less than the distance to a corresponding edge of the key slot member;

(3) forming an upstanding rib in a portion of said key slot member adjacent and parallel to each key slot side wall, each rib having a width dimension, extending in a direction normal to a length dimension of said key slot side wall, less than a distance between said key slot side wall and an edge of said key slot member corresponding to said key slot side wall;

(4) smoothly merging forward ends of said ribs with said rearward continuations of said maximum thickness portions of said first nose portions, said continuations having respective width dimensions substantially equal to a width dimension of said ribs;

(5) decreasing a thickness dimension of each of said ribs in a rearwardly direction and smoothly merging rear ends of said ribs into said outer surface of said key slot member at positions adjacent said rear end walls of said key slots;

(6) forming a pair of second portions of said nose, each of said second nose portions having convex outer surfaces in planes extending transversely and longitudinally of said key slot member and constituting smooth continuations of said convex surface of said first nose portions;

(7) extending such second convex nose portions rearwardly of respective front ends of said ribs and outwardly thereof to respectively corresponding top and bottom edges of said key slot member;

(8) decreasing a thickness dimension of each of said second portions of said nose in a rearward direction from a maximum thickness adjacent said front ends of said ribs, and (9) smoothly merging said second portions of said nose through rearwardly terminal concave surfaces into said outer surface of said key slot member at positions intermediate said front and rear ends of said ribs.

15. A method, according to claim 14, further comprising extending said maximum thickness portion of said first portion of said nose rearwardly of said front end wall of said key slot and along corresponding forward portions of said key slot side walls a distance sufficient to prevent deformation of said key slot member thereby effectively prolonging said service life of said yoke up to a normally expected service life of a railway car.

16. A method, according to claim 15, further comprising:

(A) forming said rounded nose in the form of an arc described by a radius of a circle lying in a horizontal plane extending through a longitudinal centerline of a corresponding key slot with a center point of such circle spaced about ¼ inch rearwardly of a forwardmost point of the front key slot end wall of said corresponding key slot, and (B) restricting a maximum forward position of said rounded noses of said key slot members between such front and rear force-transmitting members under application thereto of buff force when said yoke is mounted within such hollow center sill by limiting a maximum length dimension of that part of said first portion of each said rounded nose which extends forwardly of a corresponding key slot front end wall and substantially along a longitudinal centerline of a corresponding key slot to about 3 inches as compared to a 3 ½ inch corresponding length of standard AAR Y40-type coupler yokes, thereby providing a clearance space, between such front and rear force-transmitting members and said yoke when said yoke is elongated in a direction along said yoke centerline under application to said yoke of buff and draft forces over a prolonged yoke service use period, sufficient to permit removal from such hollow center sill of said yoke and a draft gear mounted within such draft gear pocket when such draft gear is compressed against such rear force-transmitting member for such removal without interference between said rounded noses of said key slot members and such front force-transmitting member and without destruction of said yoke and without destruction or removal of a force-transmitting member, and whereby loss of strength of said key slot members due to reduction of the length of said noses is avoided and in-service stress-induced deformation of said key slots is prevented by application of steps (1)–(9).

* * * * *

UNITED STATES PATENT AND TRADEMARK OFFICE

CERTIFICATE OF CORRECTION

PATENT NO. : 5,096,076

DATED : March 17, 1992

INVENTOR(S) : William O. Elliott et al.

It is certified that error appears in the above-identified patent and that said Letters Patent is hereby corrected as shown below:

Column 1, line 33, delete "wall", and insert —walls the rear—

Column 7, line 17, delete "hear", and insert —head—.

Column 7, line 19, delete "hear", and insert —head—.

Column 9, line 46, after said, first occurence, insert —hollow—.

Signed and Sealed this

Tenth Day of January, 1995

Bruce Lehman

*Attest:*

BRUCE LEHMAN

*Attesting Officer*

*Commissioner of Patents and Trademarks*